US009087657B2

(12) United States Patent
Urayama

(10) Patent No.: US 9,087,657 B2
(45) Date of Patent: Jul. 21, 2015

(54) INPUT DEVICE HAVING ILLUMINATION FUNCTION

(71) Applicant: Alps Electric Co., Ltd., Tokyo (JP)

(72) Inventor: Shinya Urayama, Miyagi-Ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 231 days.

(21) Appl. No.: 13/776,264

(22) Filed: Feb. 25, 2013

(65) Prior Publication Data

US 2013/0242531 A1 Sep. 19, 2013

(30) Foreign Application Priority Data

Mar. 13, 2012 (JP) ..... 2012-055950

(51) Int. Cl.

*H01H 19/02* (2006.01)
*G05G 1/10* (2006.01)
*H01H 9/18* (2006.01)

(52) U.S. Cl.

CPC ..... *H01H 19/025* (2013.01); *G05G 1/105* (2013.01); *H01H 9/182* (2013.01); *H01H 2219/062* (2013.01); *H01H 2219/0622* (2013.01)

(58) Field of Classification Search

CPC ..... H01H 19/025; H01H 9/161; H01H 9/182; G05G 1/105
USPC ..... 362/23.07–23.13, 23.19–23.2, 23.22
See application file for complete search history.

(56) References Cited

U.S. PATENT DOCUMENTS

| | | | | |
|---|---|---|---|---|
| 5,093,764 | A | 3/1992 | Hasegawa et al. | |
| 5,736,696 | A | 4/1998 | Del Rosso | |
| 7,036,188 | B1 * | 5/2006 | Howie, Jr. | 16/441 |
| 2007/0119484 | A1 * | 5/2007 | Kwon et al. | 134/58 R |
| 2008/0205056 | A1 * | 8/2008 | Fujiwara et al. | 362/246 |
| 2014/0056022 | A1 * | 2/2014 | Camli et al. | 362/551 |

FOREIGN PATENT DOCUMENTS

EP 0976972 A2 2/2000

OTHER PUBLICATIONS

Extended European Search Report issued in corresponding European Patent Application No. 13151188.3, mailed Jul. 19, 2013, 4 pages.

* cited by examiner

*Primary Examiner* — Sean Gramling
*Assistant Examiner* — Gerald J Sufleta, II
(74) *Attorney, Agent, or Firm* — Brinks Gilson & Lione

(57) ABSTRACT

An operating knob including a first illumination portion with an annular shape and a second illumination portion, is provided around the operating knob. The operating knob is configured by a combination of an inner shaft body made of a resin and a grip ring body, allowing the inner shaft body to be fitted outward. A light shielding cap is attached to a front end portion of the inner shaft body. A cylindrical light guide portion having the first illumination portion in the front end face and a drive portion to be connected to a rotating shaft are integrally molded in the inner shaft body, and a rear end face of the cylindrical light guide portion opposes a first light emitting face. A light incident face opposes a light source and the first and second illumination portions and are illuminated by light of the light source via the light guide member.

5 Claims, 4 Drawing Sheets

INPUT DEVICE HAVING ILLUMINATION FUNCTION

CLAIM OF PRIORITY

This application claims benefit of Japanese Patent Application No. 2012-055950 filed on Mar. 13, 2012, which is hereby incorporated by reference in its entirety.

BACKGROUND OF THE DISCLOSURE

1. Field of the Disclosure

The present disclosure relates to an input device having an illumination function which illuminates light using the light from the rear, and particularly to an improvement of an illumination mechanism in the input device in which an operating member to be in a rotating operation and an illumination portion therearound are arranged.

2. Description of the Related Art

Various illumination portions are generally provided in an input device of vehicle equipment such as a car audio system or a car air conditioner to visually recognize operating positions or action states even in a dark place at night or the like. That is, a user is allowed to perform a desired operation even in the dark place by illuminating a partial region of an operating member as an indicator or by illuminating characters, symbol marks or the like which display functions or the like around the operating member.

In a case where an illumination portion is provided on the operating member to be in a rotating operation, a technology has been well known in the related art, where a light guide body is embedded in a portion of the operating member and by emitting light of a light source to the light guide body from the rear, a front end face of the light guide body forms the illumination portion. In addition, an illumination mechanism has been also proposed in the related art (for example, PCT Japanese Translation Patent Publication No. 10-508140), where since the light guide body can be formed as a resin mold product, an extended portion formed by extending a portion of the light guide body provided in the operating member is located in the rear of the other illumination portion which displays the functions or the like around the operating member and thereby the light of one light source is caused to illuminate by allocating the light to the illumination portions at multiple places.

Incidentally, if an operating member to be in a rotating operation by a user can include an illumination portion extending annularly over the entire periphery thereof, high quality illumination with an excellent design can be achieved. However, a configuration where an annular illumination portion provided in the operating member capable of the rotating operation and the other illumination portion therearound are illuminated using the same light source has not yet realized.

SUMMARY

An input device having an illumination function of the present invention includes: an operating member having a first illumination portion and capable of the rotating operation; a front panel having an opening portion which exposes the operating member and having a second illumination portion in the vicinity of the opening portion; a light source installed in the internal space covered by the front panel; a light guide member that has a light incident face opposing the light source and guides light of the light source to the first and second illumination portions; and a rotary electrical component having a rotating shaft to be in the rotating operation caused by the operating member. The operating member is configured by a cylindrical light guide portion where the first illumination portion is annularly formed on the front end face; an inner shaft body made of a transparent resin, integrally molded with a drive portion to be connected to the rotating shaft; and a grip ring body fitted outward around the cylindrical light guide portion, being integrally rotated therewith. The light guide member has a first light emitting face which emits the light to the rear end face, the light guide member opposing the rear end face and over the entire periphery of the cylindrical light guide portion; and a second light emitting face which emits the light to the second illumination portion.

In the input device having the illumination function configured in this manner, the rear end face of the cylindrical light guide portion integrally molded in the inner shaft body of the operating member capable of the rotating operation opposes the light emitting face of the light guide member over the entire periphery. Accordingly, it is possible to illuminate the annular illumination portion provided in the operating member capable of the rotating operation and the plurality of the illumination portions, using the same light source. In addition, it is possible to illuminate the first illumination portion with the annular shape (front end face of the cylindrical light guide portion) over the entire periphery with uniform brightness. In addition, the light of the light source can be allocated to the first illumination portion and the second illumination portion by the light guide member. Consequently, the cost is decreased compared with a case of preparing a dedicated light source in the first illumination portion with the annular shape. In addition, the drive portion to be connected to the rotating shaft of the rotary electrical component is also integrally molded in the inner shaft body. Accordingly, if a user rotates the grip ring body fitted outward around the cylindrical light guide portion, the rotating shaft is driven to rotate along therewith and thus a desired input operation can be performed. In addition, since the drive portion and the cylindrical light guide portion are integrally molded in the inner shaft body, there is no need to respectively provide a separate member. Therefore, a miniaturized device with a simple configuration can be realized.

DESCRIPTION OF THE EXEMPLARY EMBODIMENTS

Figure 1:
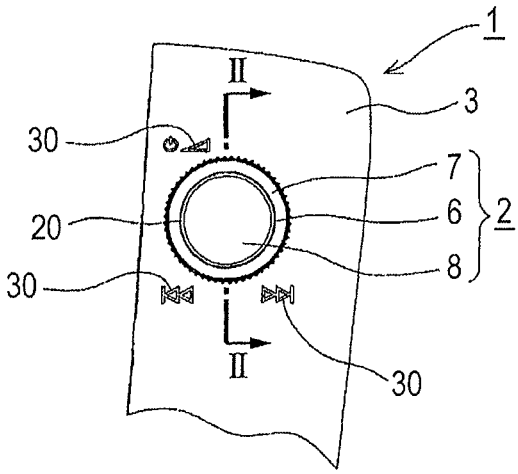
FIG. 1 is a front view of an input device having an illumination function according to an embodiment of the present invention.
Figure 2:
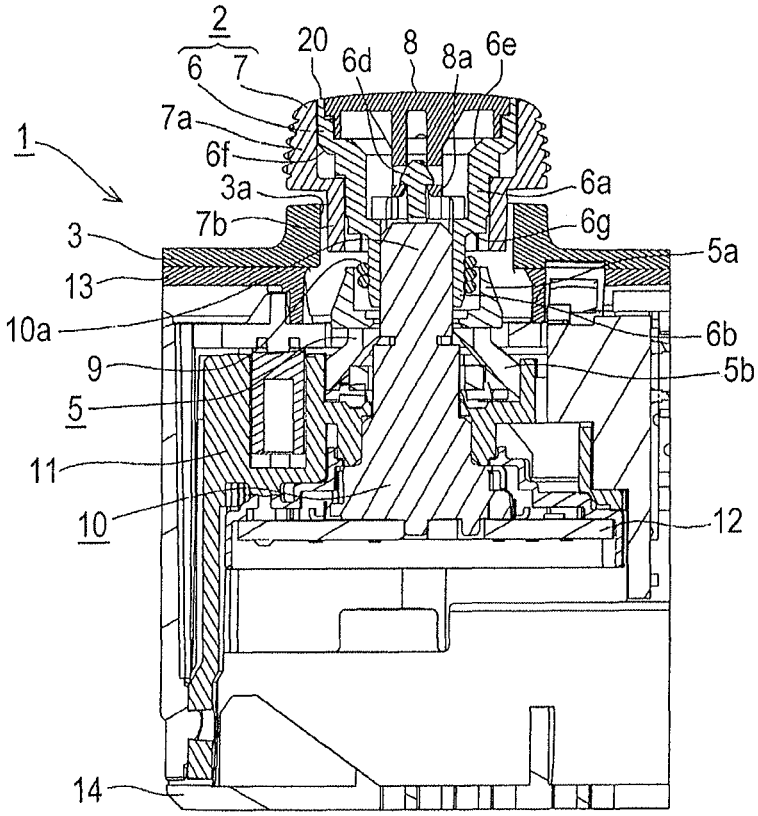
FIG. 2 is a cross-sectional view along the line II-I in FIG. 1.
Figure 3:
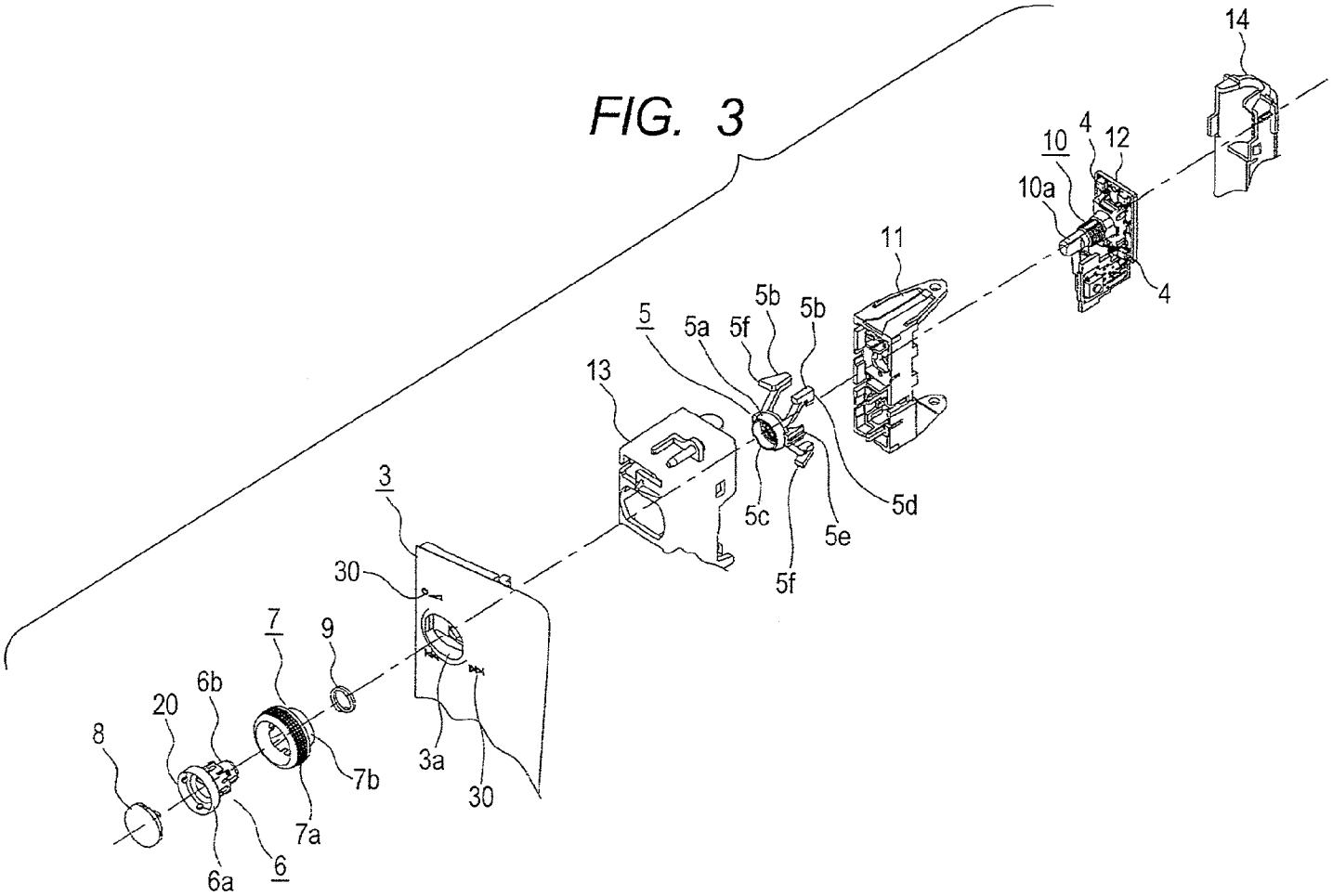
FIG. 3 is an exploded perspective view of the input device.

Embodiments of the present invention are described with reference to the accompanying drawings. An input device 1 according to an embodiment of the present invention is one of various input devices provided in car audio systems. As illustrated in FIGS. 1 to 3, the input device 1 includes an operating knob 2, which protrudes from a front panel 3 and is capable of rotating operation, and a first illumination portion 20 which is annularly extended over the entire periphery is provided on the front end face of the operating knob 2. In addition, a second illumination portion 30 is respectively arranged at three places around the operating knob 2 on the front panel 3. Then, the first and second illumination portions 20 and 30 are illuminated by the light of an LED (light source) 4 emitted from the rear via the light guide member 5.

The operating knob 2 is configured in combination of an inner shaft body 6 molded with resin and a grip ring body 7 fitted outward around the inner shaft body 6 and rotated integrally therewith, and a light shielding cap 8 (light shielding member) is attached to the front end face of the inner shaft body 6. As illustrated in FIG. 2, the operating knob 2 is inserted to an opening portion 3*a* of a front panel 3 in a state where the inner shaft body 6 and the grip ring body 7 are integrated.

Figure 4:
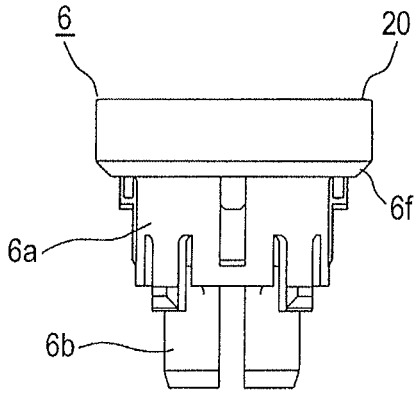
FIG. 4 is a side view of an inner shaft body provided in the input device.
Figure 5:
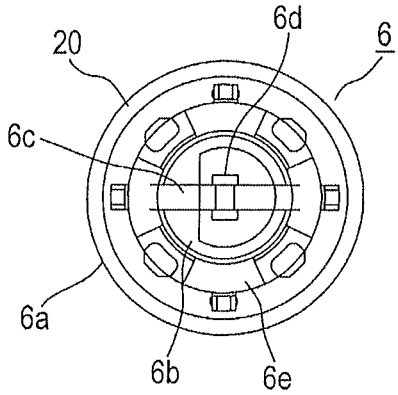
FIG. 5 is a front view of the inner shaft body.
Figure 6:
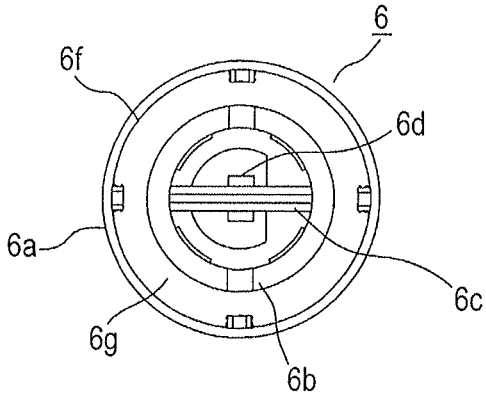
FIG. 6 is a rear view of the inner shaft body.

The inner shaft body 6 is formed from transparent resin by adding PBT (polybutylene terephthalate) to PC (polycarbonate), and secures a desired flexibility because of the added PBT. As illustrated in FIGS. 4 to 6, the inner shaft body 6 includes a cylindrical light guide portion 6*a* which is formed in a cylindrical shape having steps with different diameter sizes and which exposes a portion to the front end face of the operating knob 2; a drive portion 6*b* which protrudes in a cylindrical shape with slits rearward from the rear end portion of the cylindrical light guide portion 6*a*; a reinforcing rib 6*c* which bridges the places opposing each other on the inner peripheral face in the rear end portion of the cylindrical light guide portion 6*a*; and a retaining protrusion 6*d* which protrudes outward from the center portion of the reinforcing rib 6*c*. In the cylindrical light guide portion 6*a*, the front end side is formed with the largest diameter, and the front end face of the large diameter portion is the first illumination portion 20. In addition, the inner peripheral faces of the large diameter portion and the small diameter portion of the cylindrical light guide portion 6*a* are continuous through a tapered face 6*e* inside thereof. Likewise, the outer peripheral faces of the large diameter portion and the small diameter portion of the cylindrical light guide portion 6*a* are continuous through a tapered face 6*f* outside thereof. Furthermore, although the above-described light shielding cap 8 is not illustrated in FIGS. 4 to 6, the light shielding cap 8 is inserted into the large diameter portion of the cylindrical light guide portion 6*a* so as to be adjacent to the first illumination portion 20. An engaging portion 8*a* protruding rearward is provided on the light shielding cap 8. As a result of the engaging portion 8*a* being engaged with the retaining protrusion 6*d*, the light shielding cap 8 is stopped with a snap by the inner shaft body 6 to be integrated (refer to FIG. 2).

As illustrated in FIG. 2, since the drive portion 6*b* of the inner shaft body 6 is connected to a rotating shaft 10*a* of a rotary encoder 10, the inner shaft body 6 and the rotating shaft 10*a* are integrally rotated. A coil spring 9 (crimping member) is attached to the outer peripheral face of the drive portion 6*b*. In such a manner that the coil spring 9 pressurizes the drive portion 6*b* inward in the radial direction and crimps it onto the rotating shaft 10*a*, the relative position of the drive portion 6*b* and the rotating shaft 10*a* are no longer deviated during the rotation, and the removal force of the drive portion 6*b* is improved.

A grip ring body 7 is a molded product formed from light shielding resin such as ABS resin and includes an annular ring portion 7*a* fitted outward to the front end portion of the cylindrical light guide portion 6*a* and a small diameter portion 7*b* which is extended in the rearward direction from the annular ring portion 7*a* and fitted outward to the rear end portion of the cylindrical light guide portion 6*a*. The annular ring portion 7*a* is a part gripped by a user during the rotating operation of the operating knob 2 and knurling, serrations and the like for non-slip are applied to the outer peripheral surface thereof. As illustrated in FIGS. 1 and 2, the first illumination portion 20 is annularly exposed between the annular ring portion 7*a* and the light shielding cap 8, and the small diameter portion 7*b* is inserted to the opening portion 3*a* of the front panel 3.

The front panel 3 is integrated with a case 13 and a rear cover 14, three of which configure a housing. Then, a circuit board 12 on which a light source 4 and a rotary encoder 10 are mounted, a light guide member 5, a holder 11 or the like are installed in the internal space (space inside the housing) covered by the front panel 3. Furthermore, the second illumination portion 30 provided on the front panel 3 is that the symbol marks displaying the function and the like of the operating knob 2 are formed as a light transmitting portion.

Figure 7:
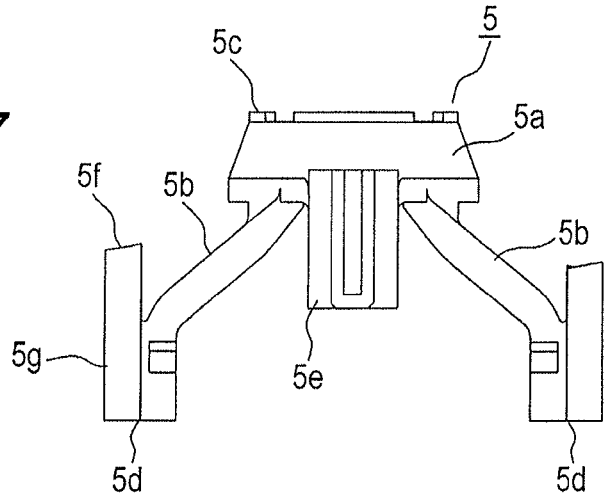
FIG. 7 is a side view of a light guide member provided in the input device.
Figure 8:
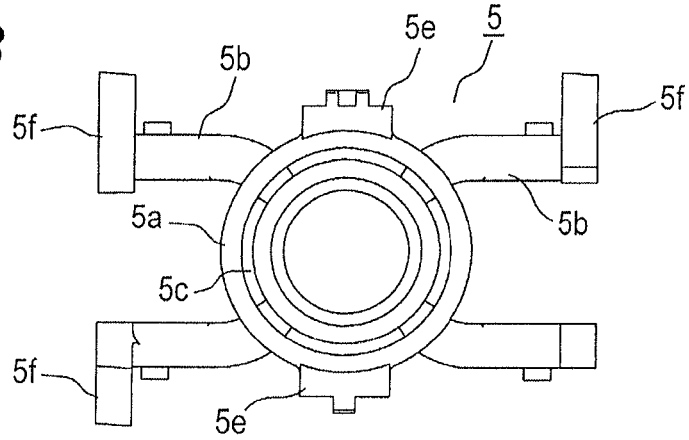
FIG. 8 is a front view of the light guide member.
Figure 9:
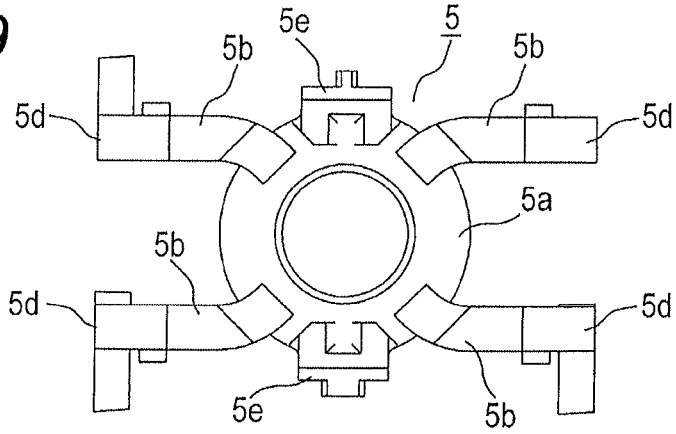
FIG. 9 is a rear view of the light guide member.

The light guide member 5 is a molded product formed from transparent resin such as polycarbonate (PC). As illustrated in FIGS. 7 to 9, the light guide member 5 includes an annular portion 5*a* having a first light emitting face 5*c* on the front end face; four leg portions 5*b* which obliquely protrudes rearward from the annular portion 5*a* and which has a light incident face 5*d* on the tip end face; and a pair of attachment portions 5*e* to be attached in a state of being positioned by the holder 11. As illustrated in FIG. 2, the front end face (first light emitting face 5*c*) of the annular portion 5*a* opposes the rear end face 6*g* of the cylindrical light guide portion 6*a* over the entire periphery. Accordingly, many of the light beams emitted from the first light emitting face 5*c* can be guided from a rear end face 6*g* of the cylindrical light guide portion 6*a* to the inside thereof, and being reflected by tapered faces 6*e* and 6*f* of the cylindrical light guide portion 6*a*, can efficiently reach the first illumination portion 20. Here, in the present embodiment, the front end face (first light emitting face 5*c*) of the annular portion 5*a* is configured to oppose the rear end face 6*g* of the cylindrical light guide portion 6*a* over the entire periphery. However, for example, it may be a discrete configuration where the first light emitting face 5*c* is partially formed along the circumferential direction. In addition, partial light guided inside the annular portion 5*a* enters from the lateral face of the drive portion 6*b* into the inner shaft body 6. Accordingly, the light emitted from the light source 4 can be allowed to reach the first illumination portion 20 much more. In addition, any of light incident faces 5*d* of respective leg portions 5*b* closely opposes the light source 4, and the respective second illumination portions 30 of the front panel 3 are illuminated by the light emitted from second light emitting faces 5*f* of the leg portions 5*b* located in the rear. The second light emitting faces 5*f* are formed from the faces opposing the respective second illumination portions 30, and the light is emitted from the faces toward the second illumination portions 30. In the present embodiment, since the second illumination portions 30 are provided at three places around the operating knob 2, the second light emitting faces 5*f* opposing the respective second illumination portions 30 are formed on three leg portions 5*b*. These three leg portions 5*b* have the light incident faces 5*d* and the light incident from the light incident faces 5*d* is partially transmitted through the leg portions 5*b*, is guided toward the annular portion 5*a*, is partially transmitted through extended light guide portions 5*g* which are extended toward the second light emitting faces 5*f* and is guided to the second light emitting faces 5*f*. Further, remaining one leg portion 5*b* does not oppose the second illumination portions 30. However, since the leg portion 5*b* also has a light guide function, which guides the light to the first light emitting face 5*c* of the annular portion 5*a*, it is possible to guide the light of the light source 4 over the entire periphery of the first light emitting face 5*c* with a uniform quantity of light.

The holder 11 is fixed to a predetermined position inside the case 13 and the holder 11 holds the light guide member 5 in a state of being positioned, via the attachment portion 5*e*. Accordingly, positioning accuracy of the light guide member 5 is highly maintained with respect to the opening portion 3*a* of the front panel 3. Therefore, it is possible to cause the front end face (first light emitting face 5*c*) of the light guide member 5 to reliably oppose the rear end face 6*g* of the cylindrical light guide portion 6*a*.

The rotary encoder 10 is a rotary electrical component, which outputs a signal corresponding to the rotation angle of the rotating shaft 10*a*. As illustrated in FIG. 2, the rotating shaft 10*a* passes through the annular portion 5*a* of the light guide member 5 and protrudes through the front panel 3 in the forward direction. Then, as described above, the drive portion 6*b* of the inner shaft body 6 is robustly connected to the rotating shaft 10*a* by a coil spring 9. Accordingly, if a user grips the grip ring body 7 and operates the operating knob 2 to be rotated, the rotating shaft 10*a* is driven to be rotated by the drive portion 6*b* and a desired input operation can be performed.

As described above, the input device 1 having the illumination function according to the present embodiment is formed of the operating knob 2 capable of the rotating operation in combination of the inner shaft body 6 and the grip ring body 7 which are integrally rotated, and the rear end face 6*g* of the cylindrical light guide portion 6*a* provided in the inner shaft body 6 made of resin is caused to oppose the front end face (first light emitting face 5*c*) of the annular portion 5*a* of the light guide member 5, over the entire periphery. Accordingly, it is possible to illuminate the first illumination portion 20 with the annular shape, which is the front end face of the cylindrical light guide portion 6*a*, over the entire periphery, with uniform brightness. In addition, the light of the light source 4 can be guided by being allocated to the first illumination portion 20 and the second illumination portion 30 using the leg portions 5*b* of the light guide member 5. Consequently, the cost can be decreased compared to a case of preparing a dedicated light source in the first illumination portion 20 with the annular shape. In addition, the drive portion 6*b* to be connected to the rotating shaft 10*a* of the rotary encoder 10 is also integrally molded in the inner shaft body 6. Therefore, if a user operates the grip ring body 7 to be rotated, then the rotating shaft 10*a* is driven to be rotated and a desired input operation can be performed. Thus, this input device 1 can illuminate the first illumination portion 20 with the annular shape with high quality, without adversely affecting the rotating operation of the operating knob 2 in any way, which results in easy avoidance of increased cost. In addition, since the inner shaft body 6 itself is molded from resin, and the cylindrical light guide portion 6*a* and the drive portion 6*b* are integrally molded, there is no need to respectively provide a separate member. Therefore, a miniaturized device with a simple configuration can be realized. Accordingly, an optical path can be also simplified and thereby illumination with high luminance can be achieved.

In addition, it is required to have some light shielding member in the inner region of the first illumination portion 20. However, if the light shielding cap 8 is fitted to the front end portion of the inner shaft body 6 as in the present embodiment, it is possible to reliably and inexpensively prevent light leakage of the first illumination portion 20, compared to a case where the inner region of the first illumination portion 20 is molded from resin and then light shielding dyes are applied to the surface thereof.

In addition, in the present embodiment, the plurality of the leg portions 5*b* which protrudes outward from the annular portion 5*a* of the light guide member 5 has the second light emitting faces 5*f* opposing the second illumination portion 30, and the light incident from the light incident faces 5*d* of the plurality of the leg portions 5*b* is partially transmitted through the leg portions 5*b*, is guided toward the annular portion 5*a*, is partially transmitted through the extended light guide portion 5*g* extended toward the second light emitting faces 5*f*, and is guided to the second light emitting faces 5*f*. Accordingly, it is possible to change the distribution ratio of the light amount guided to the first illumination portion 20 and the second illumination portion 30 in accordance with the shape of the leg portion 5*b* and the like. Thus, in a design stage, it is possible to easily adjust a balance of the brightness during the illumination of the first illumination portion 20 and the second illumination portion 30.

In addition, in the present embodiment, since the reinforcing rib 6*c* is provided on the inner shaft body 6 of the operating knob 2, in spite of some limitations of materials such as resin, it is possible to secure required mechanical strength in the cylindrical light guide portion 6*a*. Moreover, since the inner shaft body 6 is formed as the molded product, it is possible to avoid the increased cost even if the reinforcing rib 6*c* is added.

In addition, in the present embodiment, the drive portion 6*b* of the inner shaft body 6, which allows the rotating shaft 10*a* of the rotary encoder 10 to be inserted is pressurized inward in the radial direction by the coil spring 9. Therefore, it is possible to reliably prevent deviation (slip) of the drive portion 6*b* and the rotating shaft 10*a*, which is a concern during the rotating operation, and the removal force of the drive portion 6*b* (inner shaft body 6) can be improved.

Furthermore, in the above-described embodiment, the input device which actuates the rotary encoder 10 using the rotating operation of the operating knob 2 is described. However, it may be the input device which actuates the other rotary electrical component (for example, rotary volume) using the rotating operation of the operating knob 2.

In addition, the shape of the light guide member 5, the inner shaft body 6, the grip ring body 7 or the like can be appropriately selected. For example, in a case where the second illumination portions 30 are arranged at four places around the operating knob 2, the second light emitting faces 5*f* may be respectively formed on four leg portions 5*b* of the light guide member 5, and these second light emitting faces 5*f* may be caused to oppose the respective second illumination portions 30.

In addition, even in a case where the operating knob also performs an operation other than the rotating operation (for example, pushing operation, tilting operation or the like), the illumination mechanism according to the present invention can be adopted and thereby it is possible to illuminate the annular illumination portion of the operating knob with high quality.

It should be understood by those skilled in the art that various modifications, combinations, sub-combinations and alterations may occur depending on design requirements and other factors insofar as they are within the scope of the appended claims of the equivalents thereof.

What is claimed is:

1. An input device having an illumination function, comprising:

an operating member having a first illumination portion and configured for a rotating operation;

a front panel having an opening portion, which exposes the operating member, and having a second illumination portion in the vicinity of the opening portion;

a light source installed in the internal space covered by the front panel;

a light guide member that has a light incident face opposing the light source and guides light of the light source to the first and second illumination portions; and a rotary electrical component having a rotating shaft to be in the rotating operation caused by the operating member, wherein the operating member is configured by a cylindrical light guide portion where the first illumination portion is annularly formed on the front end face; an inner shaft body made of a transparent resin, integrally molded with a drive portion to be connected to the rotating shaft; and a grip ring body fitted outward around the cylindrical light guide portion, being integrally rotated therewith, wherein the light guide member has a first light emitting face which emits the light to the rear end face, the light guide member opposing the rear end face and over the entire periphery of the cylindrical light guide portion; and a second light emitting face which emits the light to the second illumination portion;

wherein the drive portion is formed in a cylindrical shape with slits and allows the rotating shaft to be inserted, and wherein a crimping member is attached to the drive portion in order to crimp the drive portion onto the rotating shaft by pressurizing the drive portion inward in the radial direction.

2. The input device having an illumination function according to claim 1, wherein the light guide member includes an annular portion, which has the first light emitting face on the front end face and allows the rotating shaft to pass through; and a plurality of leg portions, which protrudes outward from the annular portion and has the light incident face on a tip end face, and wherein at least one of a plurality of the leg portions has an extended light guide portion which is extended toward the second illumination portion, and the extended light guide portion has the second light emitting face.

3. The input device having an illumination function according to claim 2, wherein an inner peripheral face of the annular portion and at least a portion of the drive portion are arranged opposing each other.

4. The input device having an illumination function according to claim 1, wherein a light shielding member which closes the inside region of the first illumination portion is attached to the inner shaft body.

5. The input device having an illumination function according to claim 1, wherein a reinforcing rib connecting places opposing each other on the inner peripheral face of the cylindrical light guide portion is provided in the inner shaft body.

* * * * *